United States Patent [19]

Bone

[11] 4,183,567

[45] Jan. 15, 1980

[54] ATTACHING DEVICE

[75] Inventor: Arnold R. Bone, Needham, Mass.

[73] Assignee: Dennison Manufacturing Company, Framingham, Mass.

[21] Appl. No.: 901,675

[22] Filed: May 1, 1978

Related U.S. Application Data

[63] Continuation-in-part of Ser. No. 687,786, May 19, 1976, which is a continuation-in-part of Ser. No. 494,087, Aug. 2, 1974.

[51] Int. Cl.[2] ..... B65D 33/34

[52] U.S. Cl. ..... 292/318

[58] Field of Search ..... 292/307, 316, 317, 318, 292/319, 320, 321, 322

[56] References Cited

U.S. PATENT DOCUMENTS

| | | | |
|---|---|---|---|
| 3,402,435 | 9/1968 | Merser | 292/322 X |
| 3,466,077 | 9/1969 | Moberg | 292/322 |
| 3,712,655 | 1/1973 | Fuehrer | 292/317 |
| 3,717,369 | 2/1973 | Stoffel et al. | 292/321 |
| 3,830,538 | 8/1974 | Moberg | 292/322 |
| 3,881,759 | 5/1975 | Fuehrer | 292/321 |

*Primary Examiner*—Richard E. Moore
*Attorney, Agent, or Firm*—George E. Kersey

[57] ABSTRACT

A device for attaching or affixing one article to another, or for bundling and holding articles together. The device is formed by a filamentary member having a shielded pronged socket at one end and a head at the other end. The head is insertable into the socket and is proportioned to forestall accidental or deliberate distortion of the socket, and consequent release of the head, after it has been locked in position by the prongs of the socket. The prongs desirably include appendages to enhance the locking effect.

10 Claims, 12 Drawing Figures

FIG. 1
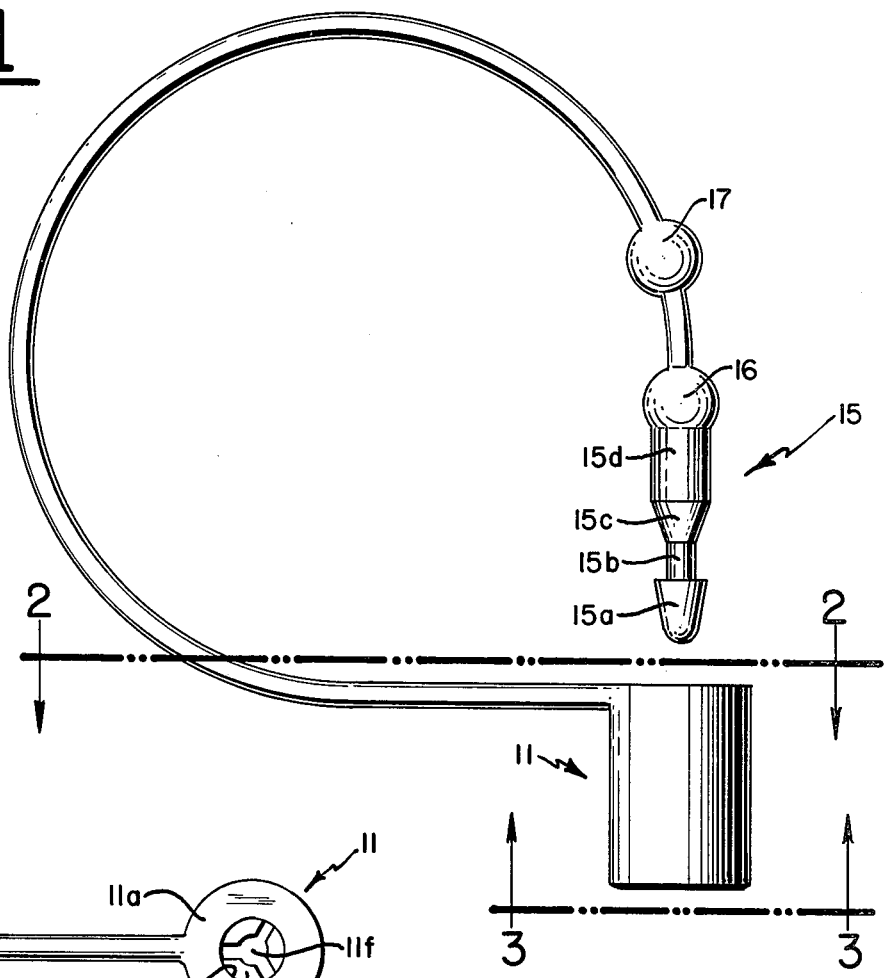
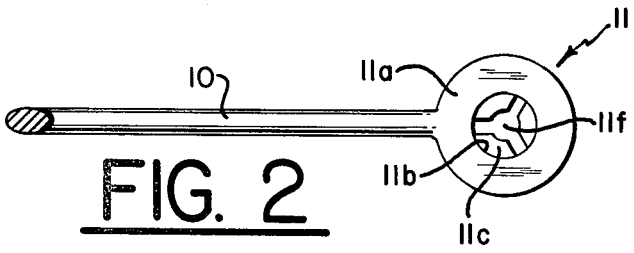
FIG. 2
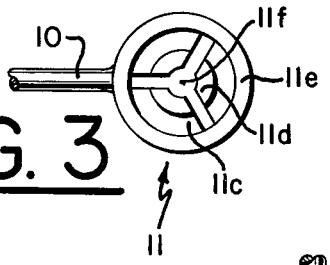
FIG. 3
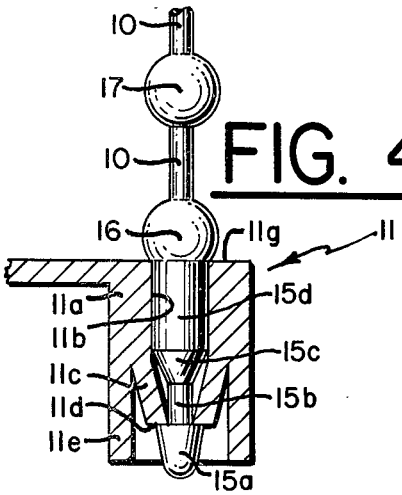
FIG. 4
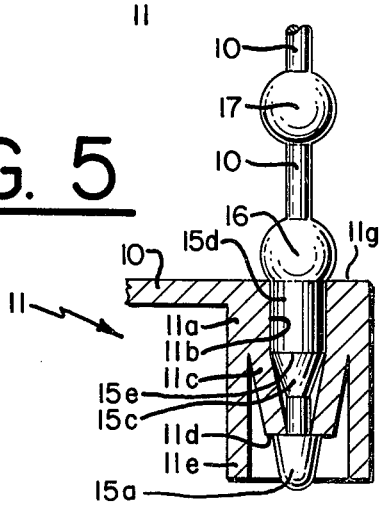
FIG. 5

ATTACHING DEVICE

BACKGROUND OF THE INVENTION

This is a continuation-in-part of Ser. No. 687,786 filed May 19, 1976, which is in turn a continuation-in-part of Ser. No. 494,087, filed Aug. 2, 1974.

The invention relates to attachment devices of the kind disclosed in U.S. Pat. Nos. 3,402,435; 3,462,802; 3,466,077; 3,516,124; 3,558,963, 3,712,655; 3,717,369; and 3,830,583; and U.S. Pat. No. Des. 214,122.

Such devices have filamentary members that are connected to pronged sockets. Each filament terminates in a head that is insertable into the associated socket cavity where it is held in position by the prongs. The devices are useful for attaching tickets and price tags to articles of merchandise. In that usage the head is passed through one or more tickets, through or about an article and finally into the socket.

The design of the socket is intended to prevent, or at least hinder the unauthorized removal of the head after it has been locked in position. Otherwise the attachment may become accidentally separated from its associated article, and the pricing ticket lost; or the head may be deliberately removed from the socket to allow "ticket switching" in which a ticket with a low price is applied to a more expensive article.

Notwithstanding various protective measures that have been taken, the prior art designs have not been successful in preventing either the accidental separation of a head from its socket or the deliberate separation of the head from the socket to permit ticket switching.

Accordingly, it is an object of the invention to enhance the security with which the head of a filamentary attaching device is locked in place in its socket. A related object is to achieve enhanced security against deliberate separation without increasing the likelihood of accidental separation of the head from the socket.

SUMMARY OF THE INVENTION

In accomplishing the foregoing and related objects, the invention provides a modification of the head so that it fills the socket cavity, except for the region of the prongs.

In accordance with one aspect of the invention undesired filling in the region of the prongs is avoided by providing a cylindrical neck near the tip of the head and coupling the neck to a truncated cone.

In accordance with another aspect of the invention a major portion of the head has a configuration similar to that of the socket, while the remainder of the head is dissimilar from the socket.

In accordance with a further aspect of the invention there is maximum clearance between the cavity and the head at an intermediate position of the prongs that form a part of the socket cavity.

In accordance with still further aspects of the invention the contour and the slope of its surface with respect to the cavity are proportioned to assure that the cavity is sufficiently filled to forestall release of the head by distortion of the socket and at the same time, prevent the kind of over-filling of the cavity that could keep the prongs from seating properly against the head.

According to yet another aspect of the invention the head of the filamentary member that is connected to the socket cavity is provided with a stop for preventing the head from being drawn through the socket. In addition the socket is provided with a shield, such as a cylindrical sleeve for preventing pressure exerted against the socket from distorting the prongs.

According to still another aspect of the invention the head is provided with one or more appendages that grip the prongs after the head is inserted into the socket in order to lock the prongs in position. This is desirably accomplished by the addition of single appendages at the tip of the prongs in order to engage an outside surface of the prongs at one or more positions when the head is inserted into the socket.

DESCRIPTION OF THE DRAWINGS

Other aspects of the invention will become apparent after consideration of several illustrative embodiments, taken in conjunction with the drawings in which:

FIG. 1 is a side view of an attaching device in accordance with the invention;

FIG. 2 is a sectional view of the device of FIG. 1 taken along the line 2—2;

FIG. 3 is a sectional view of the device of FIG. 1 taken along the line 3—3;

FIG. 4 is a sectional view of the attaching device of FIG. 1 with its head locked in position;

FIG. 5 is a sectional view of an alternative attaching device embodiment with its head locked in position;

DETAILED DESCRIPTION

Figure 6A:
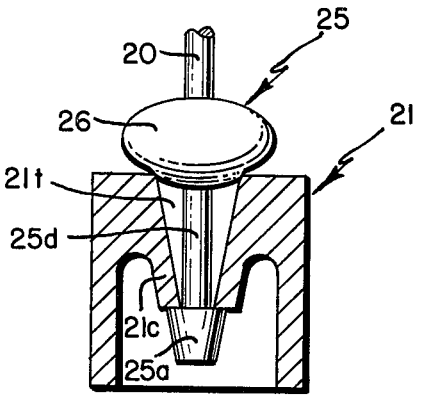
FIG. 6A (PRIOR ART)
FIG. 6A is a sectional view of a socket and associated head of a prior art type of attaching device.

As shown in the drawings, an attaching device in accordance with the invention is formed by a filamentary member or strap 10, a socket 11 and a head 15. The device is preferably made by molding a plastic material, such as nylon, as shown in certain of the reference patents. After molding, the filamentary member is desirably stretched to strengthen it.

The socket 11 includes a base member **11*a* with a desirably round opening, in a top surface 11*g*, forming the mouth or entrance of a cavity 11*b*. The cavity is completed by a plurality of resilient or snappable prongs 11*c* which define an opening 11*f* at their free ends 11*d*. Desirably included in the socket 11 is a protective shell 11*e* that extends outwardly from the base member 11*a* to prevent tampering with the prongs 11*c***.

The head 15 illustratively includes a tip **15*a* that penetrates the cavity 11*b* and spreads the prongs 11*c* until they become seated as shown in FIG. 4**.

When the tip **15*a* passes beyond the prongs they snap into place behind the tip 15*a*** to prevent its withdrawal.

Preferably the maximum width of the head is less than that of the cavity **11*b* and greater than the opening 11*f*** at the ends of the prongs.

To the rear of the tip 15*a* there is advantageously a neck 15*b* (preferably cylindrical) and a tapered portion 15*c*, preferably a truncated cone, which is coupled to a cavity filling or base member 15*d*, which is preferably cylindrical.

The cavity filling member 15*d* is constructed so that the overall clearance between its outer surface and the interior of the cavity 11*b* is less than 10 mils and preferably between 1 to 9 mils. Thus where the member 15*d* is cylindrical and the cavity opening is round, the latter diameter should be 1 to 9 mils and less than 10 mils greater than the diameter of the cylindrical member.

In addition the length of the cavity filling member 15*d* should be such that at least 70% of the cavity 11*b* is filled when the tip 15*a* is positioned as shown in FIG. 4.

Above the head 15 and supported by the filamentary member 10 is a stop 16, as well as an enlarged portion 17. The stop 16 in the preferred embodiment acts to maintain the cavity filling member 15*d* within the base member 11*a* when the head 15 is in the position shown in FIG. 4. The members 16 and 17 also help one hold the filament to insert the head 15 into the socket 11.

In FIG. 5 there is a modification of the attachment device filament according to the invention. In this embodiment the stop 16 is moved rearwards and the shoulder 15*e* between the members 15*c* and 15*d* acts to engage the inner walls of the prongs 11*c* and locate the cavity filling member 15*d* within the cavity of the member 11*a*.

The invention prevents distortion of the member 11*a* and thus opening of the prongs 11*d* by keeping the clearance of the cavity filling member 15*d* and cavity 11*b* within certain precise limits. This is by contrast with the prior art devices such as shown in FIGS. 6A, 6B, 7A and 7B.

Figure 6B:
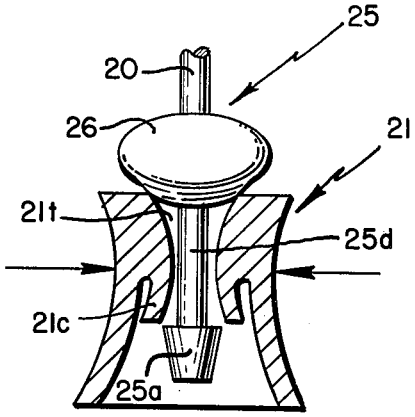
FIG. 6B is a view of the device of FIG. 6A when subjected to distortion.

Thus in FIG. 6A, a head 25 at one end of a filamentary member 20 of a prior art attaching device is shown locked in position in a socket 21. The head is formed by a stop 26 that is joined to a tip 25*a* by a thin cylindrical rod 25*d*. It is held in position in the socket by the stop 26 and the prongs 21*c* that snap into place behind the tip 25*a*. The channel in the socket 21 is a truncated conical void 21*t*. When side pressure is applied, the walls of the socket become depressed as shown in FIG. 6B, allowing the tip 25*a* to be easily withdrawn.

Figure 7A:
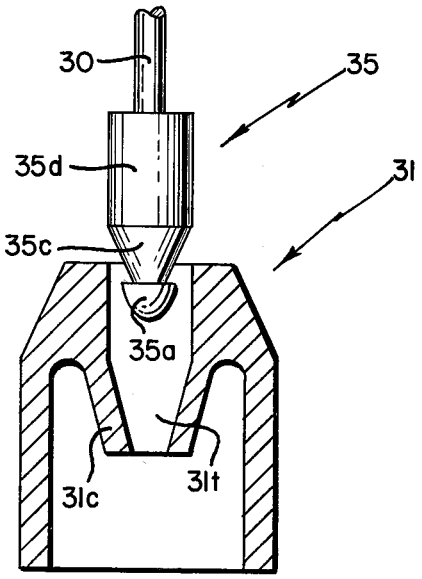
FIG. 7A (PRIOR ART)
FIG. 7A is a sectional view of a socket and associated head of another prior art type of attaching device.

In another prior art device shown in FIG. 7A a head 35 at one end of a filamentary member 30 has a base member 35*d* that is connected to a tip 35*a* by a tapered member 35*c*. If the head 35 does not closely follow the configuration of the channel 31*t* in the socket 31, the fingers 31*c* cannot properly grip the head 35.

Figure 7B:
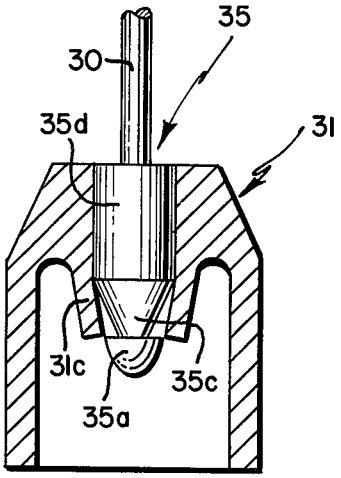
FIG. 7B is a view of the device of FIG. 7A showing prong distortion when the head is inserted into the socket.

For example, as shown in FIG. 7B, where the base member 35*d* of the head 35 is slightly longer than the upper part of the channel 31*t* the fingers 31*c* are distended, permitting easy removal of the head 35. Alternatively for example, if the conical portion 35*c* of the head 35 is larger than the lower part of the channel 31*t*, there is continuous undesirable stress on the fingers which can produce a fatigue effect that permits easy withdrawal of the head 35.

Figure 8A:
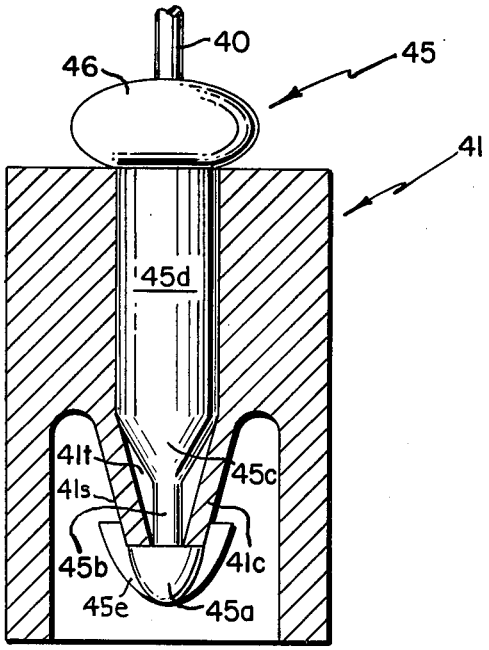
FIG. 8A is a sectional view of a further attaching device in accordance with the invention with its head locked in position.
Figure 8B:
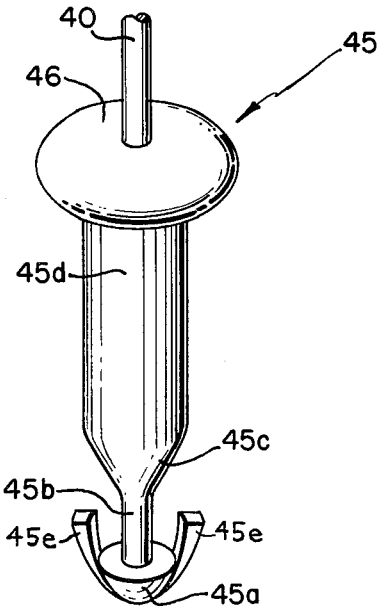
FIG. 8B is a perspective view of the head of the device shown in FIG. 8A.
Figure 8C:
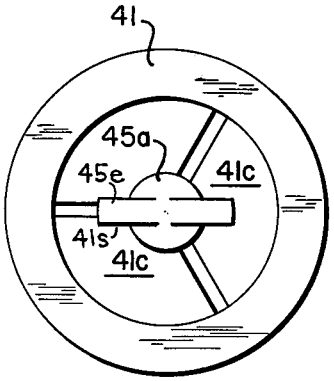
FIG. 8C is an end view of the socket showing its prongs locked in position by an inserted head.

The difficulties with the prior art devices are overcome by the invention, which is further illustrated in FIGS. 8A through 8C. The head 45 is formed by a base 45*d* with a tip 45*a* which extends to a cylindrical neck 45*b* by flared member 45*c*. The latter has a surface curvature that has a change in slope between the neck 45*b* and the base 45*d*. As a result there is maximum clearance between the channel cavity 41*t* and the head 45 at an intermediate position of the prongs 41*c*.

The neck 45*b* has a diameter that is equal or slightly less than the opening at the end of the prongs. This, coupled with the intermediate void 41*t* between the flared member 45*c* and the prongs 45*c*, prevents undesired distention of the prongs when the head 45 is locked in position. In addition the tip 45*a* has locking appendages 45*e* which grip the outer surface 41*s* of the prongs 41*c* at one or more positions as illustrated by FIGS. 8A and 8C. At the same time the proportions of the head 45 prevent lateral compression of the socket from permitting inadvertent or unauthorized withdrawal of the head 45 from the socket 41.

In particular the outer surface of the head 45 forms an acute angle with the inner surface of the prongs 41*c*, and the head 45 has a contoured surface with a continuous change of slope from the neck 45*b* to the base 45*d*. The locking appendages of the tip 45*a* may take any convenient form for the purpose of enhancing the security against tampering afforded by the invention.

The continuous change in slope is characterized by going from a minimum to a maximum and then returning to a minimum over the region of the prongs 41*c*. It is to be noted that in the case of the attaching device shown the base 45*d* has a length which exceeds the combined lengths of the neck 45*b* and the flared member 45*c*. This enhances the security against tampering afforded by the invention, but it is to be noted, for example in FIG. 5, that the base, e.g. 15*d* may have a length which is less than the combined lengths of the neck and the conical portion 15*c*.

The foregoing disclosure is illustrative only and other aspects of the invention will become apparent to those of ordinary skill in the art.

I claim:

1. An attaching device comprising a socket having a cavity therein that extends from a mouth at one side through a plurality of prongs terminating in an opening, said prongs having interior and exterior surfaces;

and a filamentary member having one end connected to the socket and the other end connected to a head;

said head having appendages for gripping the exterior surfaces of said prongs when said head is inserted into said socket.

2. An attaching device according to claim 1 wherein the head has a cylindrical neck coupled to a tip that is larger than the opening of the prongs, and a truncated cone coupled to the neck.

3. An attaching device according to claim 1 wherein the major portion of the head has a configuration that is similar to the socket and a minor portion that is dissimilar to the socket.

4. An attaching device according to claim 1 wherein the unfilled portion of the cavity has maximum clearance with respect to the head at an intermediate position along the length of the prongs.

5. An attaching device according to claim 1 wherein the outer surface of the head forms an acute angle with the inner surface of the prongs.

6. An attaching device according to claim 1 wherein the head has a contoured surface with a continuous change of slope over a prescribed interval.

7. An attaching device according to claim 1 wherein said head has a surface slope in the region of said prongs which changes from a minimum to a maximum.

8. An attaching device according to claim 1 wherein said head has a surface slope which is a minimum at the ends of said prongs and which increases in the region of said prongs.

9. An attaching device according to claim 7 wherein said slope decreases after it increases.

10. An attachment device according to claim 7 wherein said slope begins to increase at an intermediate position in the region of said prongs.

* * * * *